US005132536A

United States Patent [19]

Döbler

[11] Patent Number: 5,132,536

[45] Date of Patent: Jul. 21, 1992

[54] GAUGE HEAD FOR A QUADRUPOLE MASS SPECTROMETER

[75] Inventor: Ulrich Döbler, Wermelskirchen, Fed. Rep. of Germany

[73] Assignee: Leybold Aktiengesellschaft, Fed. Rep. of Germany

[21] Appl. No.: 707,575

[22] Filed: May 30, 1991

[30] Foreign Application Priority Data

Jun. 6, 1990 [EP] European Pat. Off. ..... 90110681.5

[51] Int. Cl.[5] ..... H01J 49/10

[52] U.S. Cl. ..... 250/292; 250/290

[58] Field of Search ..... 250/292, 249, 290, 291

[56] References Cited

U.S. PATENT DOCUMENTS 3,075,076 8/1963 Gunther .
3,105,899 10/1963 Gunther et al. ..... 250/292
3,350,559 10/1967 Young et al. ..... 250/292
3,457,404 7/1969 Uthe ..... 250/292
3,560,734 1/1971 Barnett .
3,937,954 2/1976 Fite ..... 250/292
4,704,532 11/1987 Hua ..... 250/292
4,885,500 12/1989 Hansen et al. ..... 250/281

FOREIGN PATENT DOCUMENTS 1379515 10/1975 United Kingdom .
2138201 7/1984 World Int. Prop. O. .

*Primary Examiner*—Jack I. Berman
*Assistant Examiner*—Kiet T. Nguyen
*Attorney, Agent, or Firm*—Wall and Roehrig

[57] ABSTRACT

A simple, compact and reliable quadrupole mass spectrometer head gauge is shown in which an ion source and flange are mounted on one end of a one-piece quadrupole separating system and a detector is mounted on the other end with the flange end being adapted to be connected to a vacuum chamber.

14 Claims, 2 Drawing Sheets 1
2
3
4
5
6
7
8
11
12
13
14
16
17
21
22
23
24
25
26
27
28

1
2
3
4
5
6
7
8
11
13
14
16
17
31
32
33
34
35
36
37

1
2
4
5
6
16
17
38

FIG.4
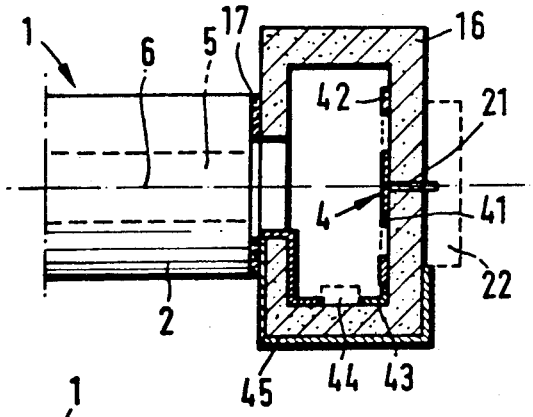
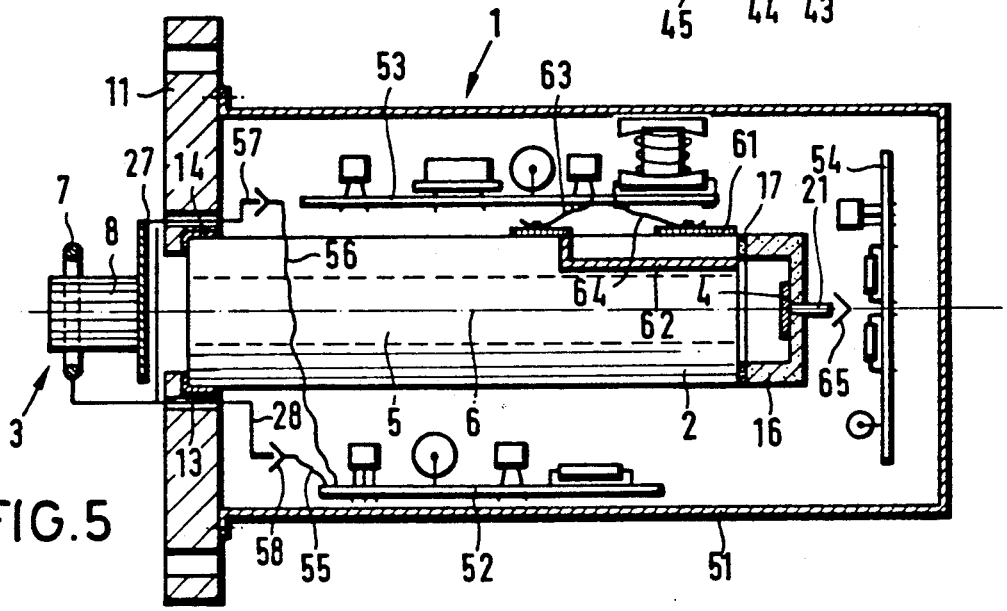
FIG.5
FIG.6
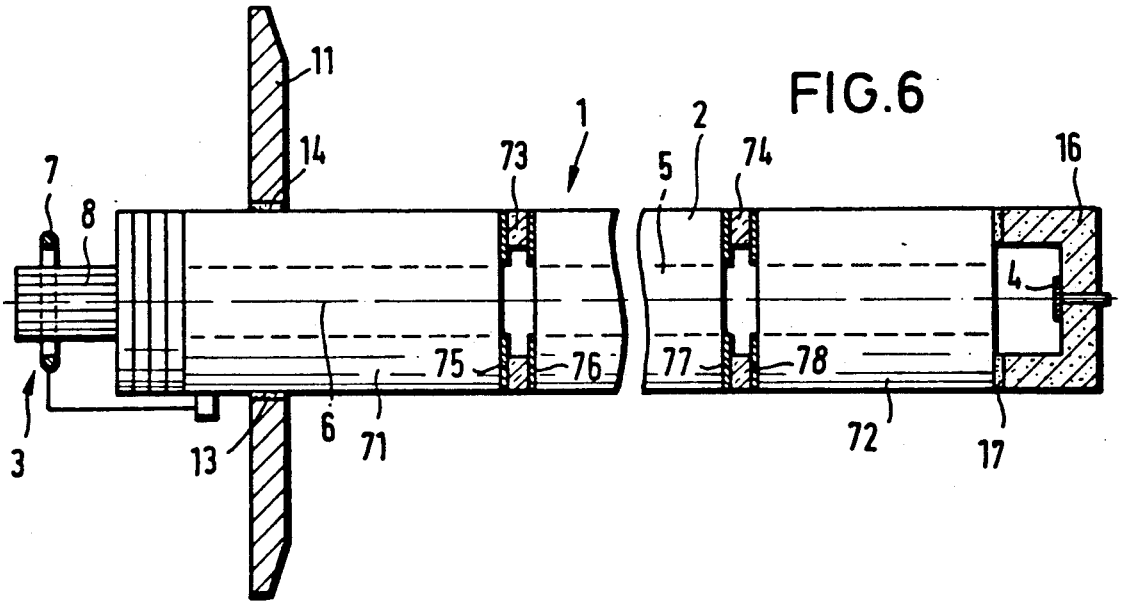

GAUGE HEAD FOR A QUADRUPOLE MASS SPECTROMETER

BACKGROUND OF THE INVENTION

1. Field of the Invention

The present invention relates to a gauge head for a Quadrupole mass spectrometer with an ion source, a one-piece Quadrupole separating system, a detector, a flange for attachment of the gauge head to a vacuum chamber and carrying parts for these components.

2. Description of the Related Art

A gauge head of this type is disclosed in the publication "Grundlagen der Vakuumtechnik, Berechnungen and Tabellen" published by Leybold-Heraeus GmbH, FRG, Edition 11/82, pages 58 and 59. The Quadrupole separating system consists of a one-piece cylindrical ceramic part with a paraxial opening. The cross section of this opening has the shape of four hyperbolic branches arranged symmetrically about the cylinder axis. The hyperbolically shaped surfaces are furnished with metal coatings, forming four electrodes with a hyperbolic cross section. A high frequency voltage with superimposed DC component is applied to these electrodes. Depending on the magnitude of these voltages an ion having the mass number M may pass or not pass the separating system. Quadrupole separating systems of this kind are disclosed in German Patent Applications, publication Nos. 22 15 763, 23 47 544 and 26 25 660.

A state of the art quadrupole gauge head requires a main carrier, made of metal with numerous current feedthroughs. Attached to this carrier is the flange which is used to attach the gauge head to a matching flange on the vacuum chamber. The wires leading through the carrier are terminated by a system of connectors at the outside of the flange, to which supply voltages and signal processing components are connected. Detector and Quadrupole separating system are held in place inside the flange by the main carrier. Moreover, a tube which surrounds the separating system is provided by the carrier. This tube carries the ion source anterior to the separating system.

The design of the aforementioned Quadrupole gauge head is costly and complex. Due to the numerous components which have to be aligned with respect to each other, time and effort spent for assembly of the gauge head is considerable. The aforementioned gauge head is highly sensitive to shocks and vibrations. The number of its components is high and subsequently the area of these components exposed to the vacuum of the vacuum chamber is large, impairing the generation of the vacuum required for operation of the mass spectrometer.

SUMMARY OF THE INVENTION

It is the object of the present invention to develop a Quadrupole gauge head of the above-mentioned type but of a much simpler design.

These and other objects are accomplished according to the present invention where the Quadrupole separating system itself is the carrier of the ion source, the detector and/or the attachment flange. This results in a surprisingly simple and stable design of the gauge head, which is consequently also much more rugged. A further advantage lies in the fact that fewer components have to be exposed to the vacuum, so that the size of outgassing surfaces which impair the production of the vacuum is considerably reduced. Therefore, a mass spectrometer designed according to the invention is much more rapidly ready for operation.

An especially advantageous measure within the scope of this invention is, that the detector is pair of a lid, which provides the vacuum tight seal for the ion ejection opening of the separating system. This measure makes it possible to employ the separating system itself as a wall of the vacuum chamber. Moreover, audio pickup effects which impair the sensitivity of the measurements are no longer present due to the entirely vibration free arrangement of the detector.

It is also expedient, to use glued joints between the Quadrupole separating system and the components. This results in a stable construction keeping assembly simple. When using non-conducting glue, there is also the possibility of feeding voltage and current carrying connection wires through the glue by way of conductive tracks formed on the Quadrupole separating system. The large number of current feedthroughs of current designs through the metal flange itself are thus no longer required.

BRIEF DESCRIPTION OF THE DRAWINGS

Further objects, advantages and details of the present invention will become apparent from the following detailed description and design examples taken in conjunction with the drawings.

FIG. 4 is a view similar to FIG. 3 of a still further embodiment;

FIG. 5 is a view similar to FIG. 1 showing a housing enclosing the gauge head; and FIG. 6 is a view similar to FIG. 1 showing pre and post filter sections.

DESCRIPTION OF THE PREFERRED EMBODIMENTS

Figure 1:
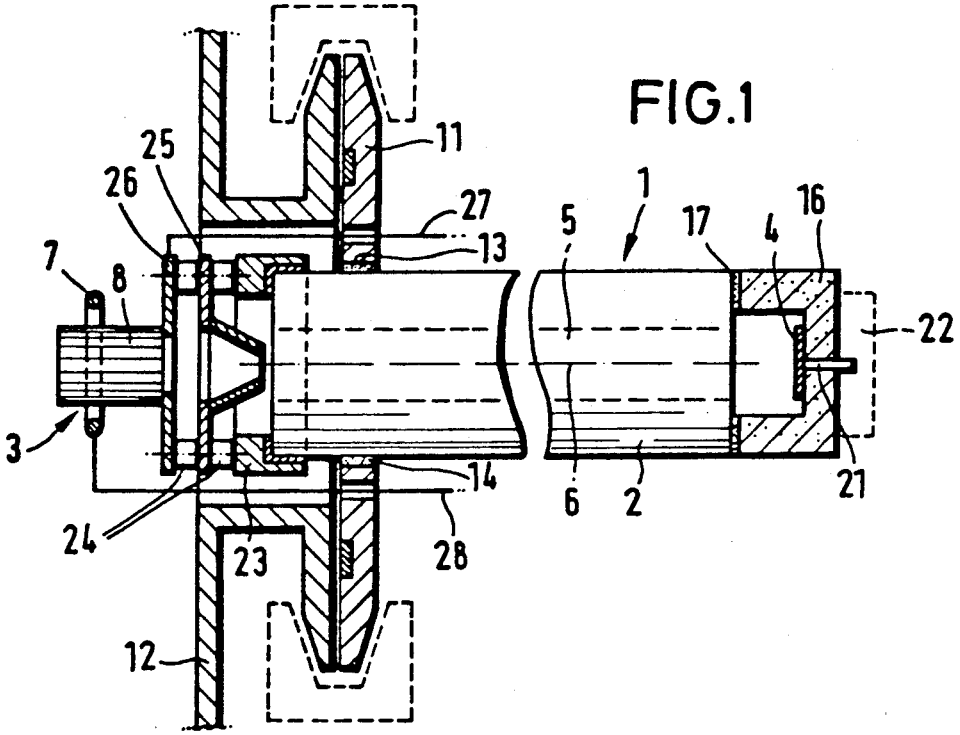
FIG. 1 is a cross sectional view of a gauge head according to the present invention.

The drawing FIGS. 1 to 6 are schematic representations of gauge heads 1 according to one aspect of the invention, where the Quadrupole separating system itself is marked 2, the ion source 3 and the detector 4. The separating system consists of a one-piece cylindrical ceramic part with paraxial opening 5, the cross section of which preferably has the shape of four hyperbolic branches arranged symmetrically about cylinder axis 6. These surfaces are furnished with metal coatings, forming four electrodes, not explicitly shown. The separating system may be a one-piece ceramic part; but it may also be composed of several glued parts forming a single unit (refer to German Patent Application, publication No. 26 25 660).

Shown as a design example for an ion source 3, is in each case an electron impact ion source which surrounds ring-shaped cathode 7 and cage-type anode 8. The carrier of these components is preferably separating system 2 itself. Also flange 11, through which gauge head 1 is attached to a vacuum chamber 12 partially shown in FIG. 1 is carried by the separating system 2 itself. Flange 11 is placed in close proximity to ion source 3, so that the surface of gauge head 1 exposed to the vacuum is as small as possible. Flange 11 surrounds separating system 2 in central opening 13. With the aid of a compression fitting or a suitable metal/ceramic glue it is possible to provide a vacuumtight and stable joint between flange 11 and separating system. In the case of the given design examples glued joints are provided. The corresponding glue layer is marked 14.

Detector 4 given in differing variations in the design examples is part of lid 16, which is employed to seal opening 5 of the frontal end of separating system 2 in the space outside the vacuum. A stable and vacuumtight joint between separating system 2 and lid 16 is again preferably made by using a suitable glue. This glue layer is marked 17.

In the design example shown in FIG. 1, detector 4 is an ion collector which is arranged at the bottom of pot-shaped lid 16 made of ceramic. Signal wire 21 is lead to the outside through a hole in lid 16. Lid 16 itself is the carrier of electronic components 22, for example a preamplifier. Electronic components 22 are only shown as a shaded block. Of course there is the possibility of employing separating system 2 itself as the carrier for electronic components.

Cage-type anode 8 of ion source 3 located within vacuum chamber 12 is carried by the frontal end of separating system 2 protruding into the vacuum chamber. Metal carrying ring 23 is glued to this frontal end for this purpose. Attached via spacers 24 made of an electrically non-conducting material preferably ceramic to carrying ring 23, are extraction electrode 25 and carrier plate 26 for cage-type anode 8. The power supply is provided via wires 27 and 28 passing through flange 11 in an insulated manner. Wire 27 is connected to cage-type anode 8. The separate voltage supply for extraction electrode 25 is not shown. Wire 28 is connected to cathode 7 and it also serves as its carrier. A separate power supply for the heater is also not shown.

Figure 2:
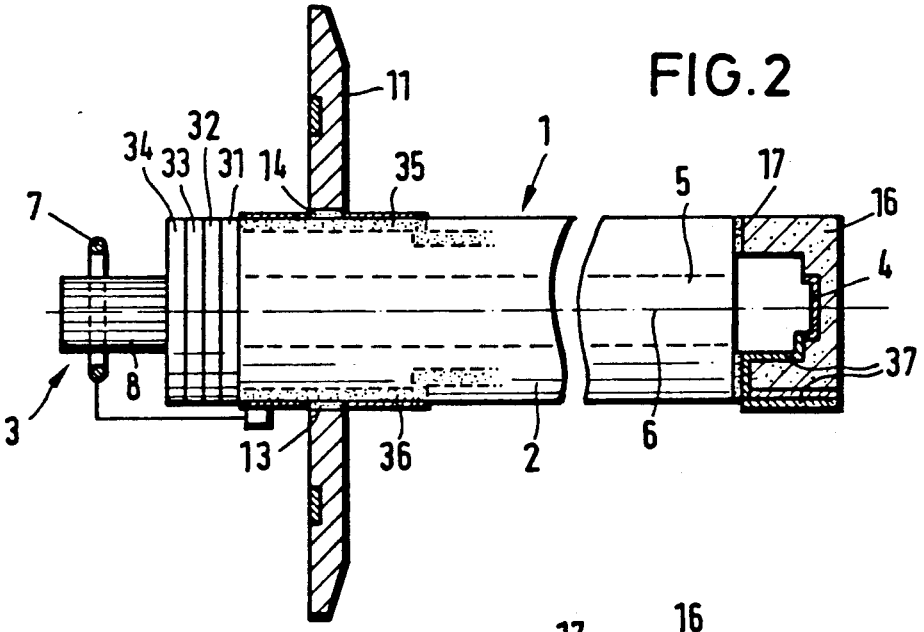
FIG. 2 is a view similar to FIG. 1 of another embodiment of the present invention.

In the design example shown in FIG. 2 the frontal end of separating system 2 in the vacuum carries four rings the individual functions of which are described in the following:

31 Isolating ring
32 Carrying ring for an ion lens
33 Isolating ring
34 Anode base plate Power is supplied to the components in the vacuum through circuit tracks 36, 36 which are produced on the surface of separating system 2. Glue layer 14 made of an electrically insulating material ensures that the feedthrough is insulated against flange 11.

The signals generated by detector 4 which is arranged as a Faraday beaker are supplied to the outside via circuit track 37. Circuit track 37 penetrates glued joint 17.

Figure 3:
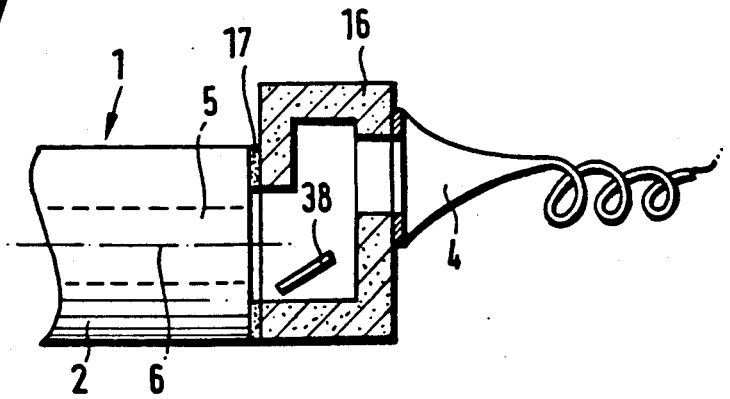
FIG. 3 is a fragmentary view partially in section of another embodiment.

Given in FIG. 3 is the detector area of a mass spectrometer based on the invention. A Channeltron is used as detector 4. This is offset with respect to axis 6 of separating system 2. The ions emerging from separating system 2 are deflected to the input of Channeltron 4 with the aid of deflection electrode 38. Alternatively a channel plate may be used instead.

In the case of the mass spectrometer shown in FIG. 4, detector 4 comprises two ion collectors 41 and 42, Collector 41 is disk-shaped. Collector 42 is ring-shaped, concentrically surrounding collector 41. Thus detector 4 has spatial resolution.

Signal wire 21 connected to collector electrode 41 is lead to outside electronics 22 through a hole in lid 16. The signal produced by ring-shaped collector 42 is supplied via circuit track 43 to preamplifier 44 within lid 16. The amplified signal is led via circuit track 45 which penetrates glued joint 17, out of lid 16, and on the outside of lid 16 it is supplied for example to electronics 22.

Shown in FIG. 5 is a design example with a different housing 51 attached to flange 11. Printed circuit boards 52, 53 and 54 are mounted within housing 51 by a method not disclosed in detail. Electronic components for supplying ion source 3 are located on printed circuit board 52. Wires 55 and 56 from printed circuit board 52 are connected to the directly feeding wires 27 and 28 via plugs 57 and 58. Wires 27 and 28 are fed through flange 11 again in an insulated manner and with such stability that they are able to carry ring cathode 7 and cage-type anode 8.

The components on printed circuit board 53 are used to generate the supply voltages for the electrodes of separating system 2. The electrodes within separating system 2 are connected to printed circuit board 53 via circuit tracks 61 and 62 leading through glued joint 17 and via metal tabs 63 and 64 above, but in contact with these tracks.

The electronic components on printed circuit board 54 serve the purpose of signal processing. Wire 21 is connected to printed circuit board 54 through plug 65.

The present invention is such, that it is easily possible to equip separating system 2 with a prefilter and/or a postfilter. A prefilter effects the first separation between desired and undesired masses, thus facilitating better focussing of the ions into the separating system. A postfilter improves the transfer of the ions to the detector. In all, the use of pre- and postfilter improves resolution and sensitivity.

In the design example shown in FIG. 6 prefilter 71 and postfilter 72 are related to separating system 2. They are also designed as Quadrupole systems and attached to separating system 2 via glued joints 73 and 74. The electronics for the power supply are not explicitly shown. The supply voltages may again be carried by circuit tracks which lead through glued joints 73 and 74. If the pre- and postfilter are only operated with AC voltages, namely from the AC voltage of separating system 2, it is then possible to arrange glued joints 73, 74 in such a way that they act a capacitors. The voltage applied to the AC electrodes of separating system 2 is then transferred via these capacitors to the electrodes of pre- and postfilter 71 and 72. Pre- and postfilter are thus insulated with reference to the DC potential of separating system 2.

The capacitors are preferably formed by metallized areas 75 to 78 located at the corresponding frontal ends. The capacitance of the individual capacitors depends on the size and the spacing of these surfaces as well as the type of glue, and also on those quantities which form the dielectric of the capacitors. Both size and arrangement of metallized sections 76 and 77 must be such, that it remains possible to apply DC voltages to the electrodes of separating system 2 via circuit tracks passing through glued joints 73 and 74.

A suitable type of glue (metal-ceramic glue or ceramic-ceramic glue) must be employed in each case for the various glued joints 14, 17, 73 and 74. In the case of metal-ceramic joints it is also possible to use glass solder and active solder or hard solder.

What is claimed is:

1. A gauge head for a quardrupole mass spectrometer comprising an ion source, a one-piece quadrupole separating system, a detector, and a flange for attaching the gauge head to a vacuum chamber, said quadrupole separating system having mounted directly thereon at one end the ion source, and adjacent said end the attachment flange and at the other end the detector, so as to form a compact, simple and stable design.

2. A gauge head according to claim 1 wherein the detector is part of the lid which provides a vacuum tight seal of the ion ejection opening of the separating system.

3. A gauge head according to claim 2, wherein the lid is the carrier of electronic components.

4. A gauge head according to claims 1, wherein the joints between separating system and the ion source, detector and flange components are glued or welded.

5. A gauge head according to claim 4, wherein the joints are made of glass solder, hard solder, active solder or similar.

6. A gauge head according to claim 4, wherein the glue or the solder used must have electrically insulating properties and where voltage or current carrying links re fed through by way of circuit tracks through the glued or welded joints.

7. A gauge head according to claim 6, wherein metal tabs are provided for linking circuit tracks to the electronic supply and/or signal processing components.

8. A gauge head according to claim 1, wherein the flange is located close to the ion source.

9. A gauge head according to claim 1, wherein the separating system additionally acts as a carrier of electronic components.

10. A gauge head according to claim 1 wherein a detachable outer housing is provided which is attached to said attachment flange mounted on the separating system within.

11. A gauge head according to claim 10, wherein electronic power supply and signal processing components are located within the housing and where connector arrangements and/or metal tabs are provided for connection of these components.

12. A gauge head according to claim 1, wherein the separating system is equipped with a prefilter, and postfilter.

13. A gauge head according to claim 12, wherein said and/or postfilter are also formed as Quadrupole systems and which are joined to the separation system via glued joints.

14. A gauge head according to claim 13, wherein the glued joints are formed as capacitors to transfer AC voltages from said separation system to the prefilter and postfilter.

* * * * *